US007278256B2

(12) United States Patent
Norris et al.

(10) Patent No.: US 7,278,256 B2
(45) Date of Patent: Oct. 9, 2007

(54) PULSED COMBUSTION ENGINE

(75) Inventors: James W. Norris, Lebanon, CT (US); Craig A. Nordeen, Manchester, CT (US); Wendell V. Twelves, Jr., Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 267 days.

(21) Appl. No.: 10/984,461

(22) Filed: Nov. 8, 2004

(65) Prior Publication Data

US 2006/0096293 A1 May 11, 2006

(51) Int. Cl.
*F02C 5/00* (2006.01)

(52) U.S. Cl. ..... 60/204; 60/248; 60/266; 60/39.38; 60/39.34

(58) Field of Classification Search ..... 60/247, 60/248, 39.38, 39.39, 39.76, 266, 754, 755, 60/752, 725, 204, 39.34
See application file for complete search history.

(56) References Cited

U.S. PATENT DOCUMENTS 2,602,291 A * 7/1952 Farnell ..... 60/39.76
3,166,904 A * 1/1965 Melenric ..... 60/746
3,349,558 A * 10/1967 Smith ..... 60/754
3,417,564 A * 12/1968 Call ..... 60/39.34
3,557,551 A * 1/1971 Campbell ..... 60/39.35
3,706,203 A * 12/1972 Goldberg et al. ..... 60/757
3,775,974 A * 12/1973 Silver ..... 60/39.34
3,793,827 A * 2/1974 Ekstedt ..... 60/757
3,899,876 A * 8/1975 Williamson ..... 60/757
4,312,186 A * 1/1982 Reider ..... 60/754
4,361,010 A * 11/1982 Tanrikut et al. ..... 60/757
6,494,034 B2 * 12/2002 Kaemming et al. ..... 60/248
6,666,018 B2 * 12/2003 Butler et al. ..... 60/226.1
7,080,514 B2 * 7/2006 Bland et al. ..... 60/725
7,104,065 B2 * 9/2006 Benz et al. ..... 60/725
2004/0123582 A1 * 7/2004 Norris et al. ..... 60/39.38
2004/0123583 A1 * 7/2004 Nordeen et al. ..... 60/226.1

FOREIGN PATENT DOCUMENTS

WO WO 03/023281 * 3/2003

* cited by examiner

*Primary Examiner*—Ted Kim
(74) *Attorney, Agent, or Firm*—Bachman & LaPointe, P.C.

(57) ABSTRACT

A pulsed combustion apparatus includes a conduit having an outer wall and an inner wall. The inner wall has a number of apertures. An interior space is separated from the outer wall by the inner wall. An induction system is positioned to cyclicly admit charges to the interior space. An ignition system is positioned to ignite the charges. Flow directing surfaces are positioned to at least cyclicly direct cooling air through the apertures.

22 Claims, 5 Drawing Sheets

PULSED COMBUSTION ENGINE

BACKGROUND OF THE INVENTION

This invention relates to pulse combustion, and more particularly to hybrid pulse combustion turbine engines.

In a conventional gas turbine engine, combustion occurs in a continuous, near constant pressure (Rankine cycle), mode. Such conventional gas turbine engine combustion is notoriously inefficient and has led to many efforts to improve efficiency.

It has been proposed to apply the more efficient combustion of near constant volume combustion pulse detonation engines (PDEs) to turbine engine combustors. In a generalized PDE, fuel and oxidizer (e.g., oxygen-containing gas such as air) are admitted to an elongate combustion chamber at an upstream inlet end, typically through an inlet valve as a mixture (e.g., of hydrocarbon fuel droplets or vapor in air). Upon introduction of this charge, the valve is closed and an igniter is utilized to detonate the charge (either directly or through a deflagration to detonation transition). A detonation wave propagates toward the outlet at supersonic speed causing substantial combustion of the fuel/air mixture before the mixture can be substantially driven from the outlet. The result of the combustion is to rapidly elevate pressure within the chamber before substantial gas can escape inertially through the outlet. The effect of this inertial confinement is to produce near constant volume combustion. It has also been proposed to use an essentially deflagration combustion in a PDE. U.S. Patent Publication Nos. 20040123582A1 and 20040123583A1 and European Patent Convention publications EP1435447A1 and EP1435440A1 disclose various configurations of pulsed combustion gas turbine engines.

BRIEF SUMMARY OF THE INVENTION

One aspect of the invention involves a pulsed combustion apparatus. The apparatus includes a conduit and an inner wall. The inner wall has a number of apertures. An interior space is separated from the outer wall by the inner wall. An induction system is positioned to cyclicly admit charges to the interior space. An ignition system is positioned to ignite the charges. Flow directing surfaces are positioned to at least cyclicly direct cooling air through the apertures.

In various implementations, the inner wall may have an array of volumes (pockets). The apertures may include, for each of the pockets: a first aperture between the interior of such pocket and a space between the inner and outer walls; and a second aperture between the interior of the pocket and the interior space. An intermediate wall may be located between the outer wall and the inner wall and may have a number of apertures. The cooling air may be directed through the intermediate wall before reaching the inner wall. The inner wall may include an inner layer and an outer layer secured to the inner layer. The outer layer may have an array of three-dimensional excursion features (e.g., dome-like blisters) cooperating with the inner layer to form the pockets. The ignition system may be effective to induce detonation of the charges.

Another aspect of the invention involves a turbine engine including a case with an axis, a compressor, a turbine, and a circumferential array of combustion chamber conduits. The conduits are downstream of the compressor and upstream of the turbine. The array is supported for continuous rotation relative to the case in a first direction about the axis to cyclicly bring each conduit from a charging zone for receiving a charge from upstream to a discharging zone for downstream discharging of products of combustion of the charge. Each of the conduits includes an outer wall and an inner wall. An interior space is separated from the outer wall by the inner wall and has an array of pockets. Each pocket may have at least one exterior port and at least one interior port.

In various implementations, the inner wall may include a first layer and a second layer secured to an outer surface of the first layer. The second layer may have an array of outward blisters cooperating with the first layer to form the pockets. A third layer may be outboard of the second layer and may have an array of orifices. There may be a first airflow substantially through the compressor and turbine with a first portion of the first airflow passing through the combustor chamber conduits in the charges and a second portion of the first airflow bypassing combustion. A mass flow ratio of the first portion to the second portion may be between 1:1 and 1:3. The engine may be a turbofan engine. The first airflow may be a core airflow and a bypass airflow may bypass the compressor and turbine. A mass flow ratio of the bypass airflow to the core airflow may be between 3:1 and 9:1. The array may be on a free spool and the rotation may be driven by partially tangential direction of products of combustion.

Another aspect of the invention involves a gas turbine engine having a compressor, a turbine coaxial with the compressor along an axis, and a pulsed combustion combustor receiving air from the compressor and outputting combustion gases to the turbine. The combustor includes a number of combustion chamber conduits having first and second portions or chambers held for rotation about the axis through a number of positions, including: at least one charge receiving position for receiving a charge from upstream; at least one initiation position for initiating combustion of the charge; at least one discharge position for downstream discharging of products of combustion of said charge; and at least one cooling position cooling a wall separating the first and second chambers by directing cooling air from the second chamber to the first chamber through a plurality of apertures in the wall.

In various implementations, there may be at least one fuel injector for injecting fuel into air from the compressor to form the charges. The at least one cooling position may overlap a majority of the at least one charge receiving position.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

A new combustor tube configuration may be applied to a turbine engine. Exemplary turbine engines and combustors may be variations on those shown in U.S. Patent Publication Nos. 20040123582A1 and 20040123583A1 and European Patent Convention publications EP1435447A1 and EP1435440A1 (the disclosures of which are incorporated by reference herein as if set forth at length).

Figure 1:
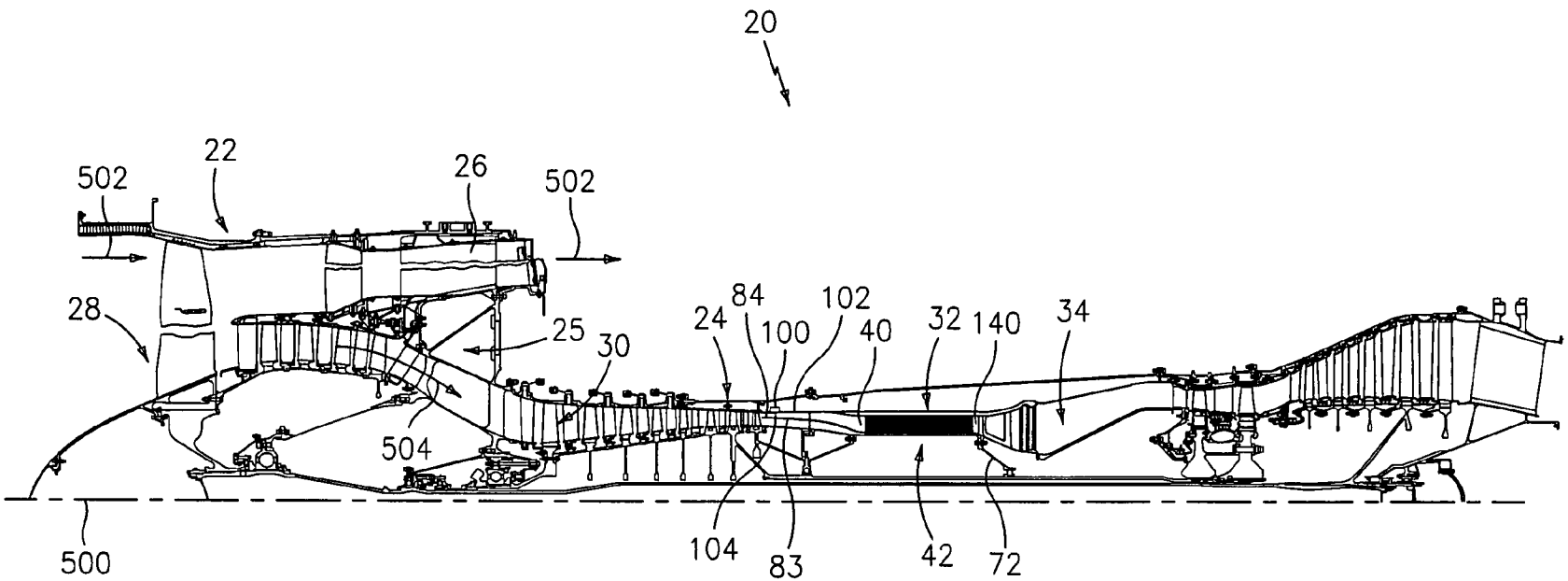
FIG. 1 is a partial longitudinal sectional view of a turbofan engine.

FIG. 1 shows a turbofan engine 20 having central longitudinal axis 500, a duct 22 and a core 24. The duct is supported relative to a case assembly 25 of the core by vanes 26. Of inlet air entering the duct, a fan 28 drives a bypass portion along a first flow path 502 radially between the duct and the core and core portion along a second flowpath 504 through the core. In the core downstream of the fan, a compressor section 30 having alternating rings of rotor blades and stator vanes compresses the core air and delivers it further downstream to a combustor section 32 where it is mixed with fuel and combusted. A mixing duct 34 downstream of the combustor may mix a portion of air bypassing fueling and combustion with the portion that is fueled/combusted. Downstream of the mixing duct, a turbine section 36 is driven by the mixing duct output to, in turn, drive the compressor and fan. An augmentor (not shown) may be located downstream of the turbine.

Figure 2:
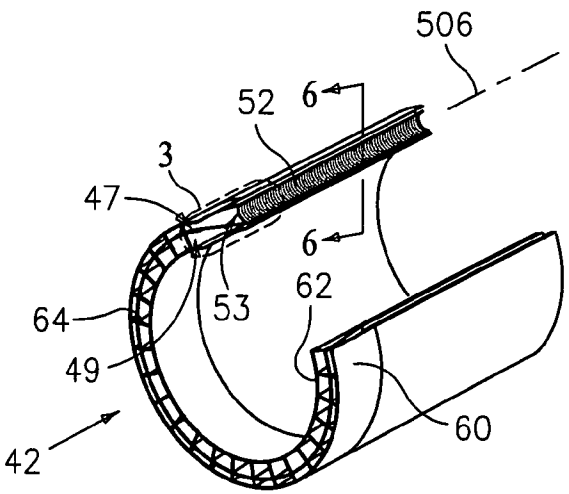
FIG. 2 is a partial isolated cut-away isometric view of a combustor of the engine of FIG. 1.

The exemplary combustor includes a ring of combustion conduits 40 which may be operated as pulsed combustion conduits. Exemplary conduits are operated as pulsed detonation devices, although a similar structure may potentially be used with pulsed deflagration. The conduits are mounted in a carousel structure 42 (FIG. 2) for rotation relative to the case assembly about the engine central longitudinal axis. In the illustrated embodiment and as discussed further below, the carousel forms a third free spool in addition to the high and low spools of the turbine/compressor combination. Other embodiments may have more or fewer spools and compressor and turbine section arrangements.

Figure 3:
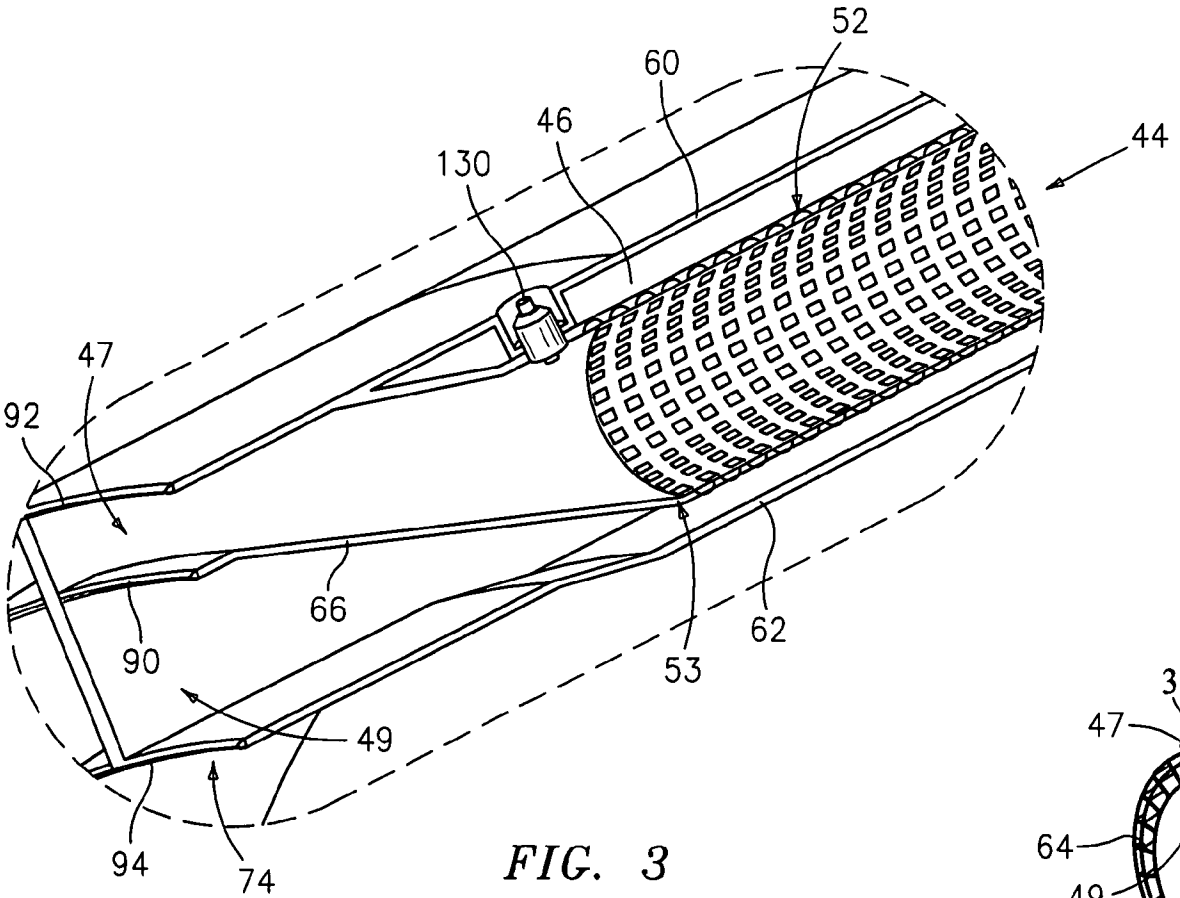
FIG. 3 is an enlarged cut-away view of an upstream end of the combustor of FIG. 2.
Figure 4:
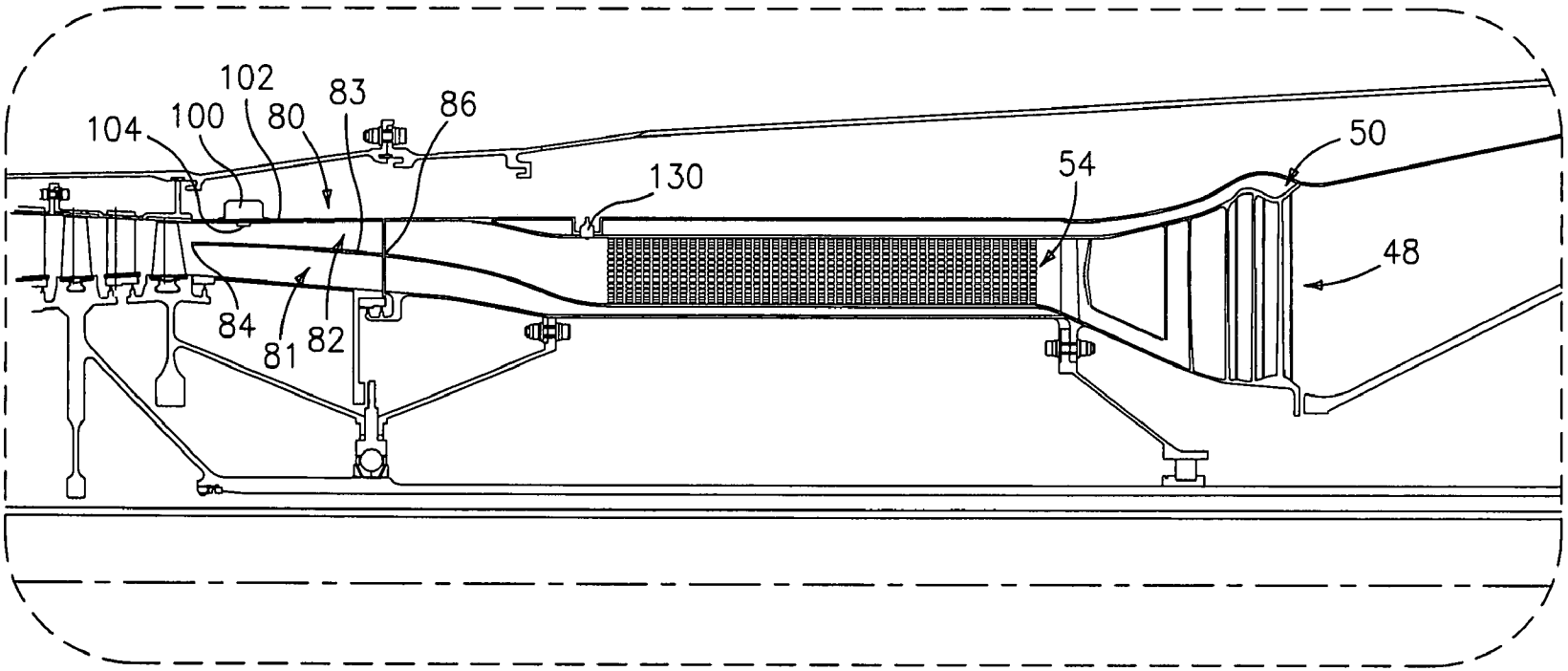
FIG. 4 is a longitudinal sectional view of the combustor of the engine of FIG. 1 along a charging sector.

Each conduit includes a first volume (chamber) 44 and a second volume (chamber) 46 (FIG. 3) that form respective first and second passageways. Each first volume 44 has a forward/upstream inlet end 47 and an aft/downstream outlet end 48 (FIG. 4). Each second volume 46 has a forward/upstream inlet end 49 and an aft/downstream outlet end 50 (FIG. 4). Along major portions of the lengths (e.g., about 50-70% or more) of the first and second volumes 44 and 46, the first volume 44 is generally concentrically surrounded by the second volume 46. Along these common lengths, a tube 52 (e.g., of annular section and straight) extends along a central longitudinal axis 506 from a tube inlet 53 to a tube outlet end 54 to separate the volumes 44 and 46. As is discussed further below, downstream of the tube outlet end 54, the cross-sectional shapes of the volumes 44 and 46 transition and may become circumferentially alternating or sandwiched.

The exemplary carousel comprises a circumferentially extending outboard wall 60 spaced apart from a circumferentially extending inboard wall 62. A circumferential array of radial/longitudinal walls 64 span between the outboard and inboard walls 60 and 62 to generally surround the individual second volumes 46. Thus, the exemplary radial walls are each shared by a pair of adjacent volumes 46, the two radial walls and intervening portions of the outboard and inboard walls 60 and 62 forming the outer "wall" of such volume 46.

At an upstream end of the carousel, the first volume 44 is essentially an outboard annular sector and the associated volume 46 is essentially an annular sector immediately inboard thereof and separated therefrom by a wall of a duct portion 66. From adjacent the upstream/inlet end 47 at the car, the first volume 44 cross-section may transition from the annular sector to another shape such as a circle at the upstream end/inlet 53 of the tube 52.

The first and second volume upstream ends 47 and 49 are proximate an aft, downstream portion of a fixed manifold 80 (FIG. 4). In the exemplary embodiment, along a charging sector of the manifold, the manifold 80 splits the core flow into two portions: an inboard portion along an inboard passageway 81 and an outboard portion along an outboard passageway 82. The passageways 81 and 83 are separated by a circumferential wall 83 having an upstream rim 84 just downstream of the last compressor stage and having a downstream rim 86. The downstream rim 86 is in close aligned proximity to an upstream rim 90 (FIG. 3) of the duct 66 radially between respective upstream rims 92 and 94 of the outboard and inboard walls 62 and 64 of the carousel. Along this charging sector, the manifold has a circumferential array of fuel injectors 100 mounted in a wall 102 of the core. The injectors have outlets 104 positioned sufficiently downstream of the rim 84 so as to introduce fuel only to the outboard portion of the core flow along the manifold outboard passageway 82. This combined fuel/air flow, in turn, passes into the first volumes 44 of a transiently aligned group of the combustion conduits 40. A sealing system (not shown) may be formed between the manifold and carousel. An unfueled portion of the core air passes though the manifold inboard passageway 81 inboard of the wall 83 and enters the second volumes 46 of the transiently aligned conduits 40.

Outside of the charging sector, in ignition/discharging sector, the manifold has a blocking element 120 (FIG. 5) that seals the inlet ends 47 of the transiently aligned first volumes 44. In the exemplary embodiment, however, the blocking element 120 effectively blocks only the outboard (fueled in the charging sector) portion of the core flow path, still permitting flow through the inboard portion, in turn, into the second volumes 46. Although the outboard portion of the core flow may be entirely blocked, in the exemplary embodiment it is merely diverted to bypass the combustor, passing outboard of the combustor through a passageway 124 formed by a local radial elevation and longitudinal extension 126 of the wall 102. This bypass diverts unfueled relatively cool air to mix with and further cool/quench the combustion products in the discharge sector. The mixing duct 34 may thus provide for a transition to circumferentially homogenize the flow entering the turbine section.

Figure 5:
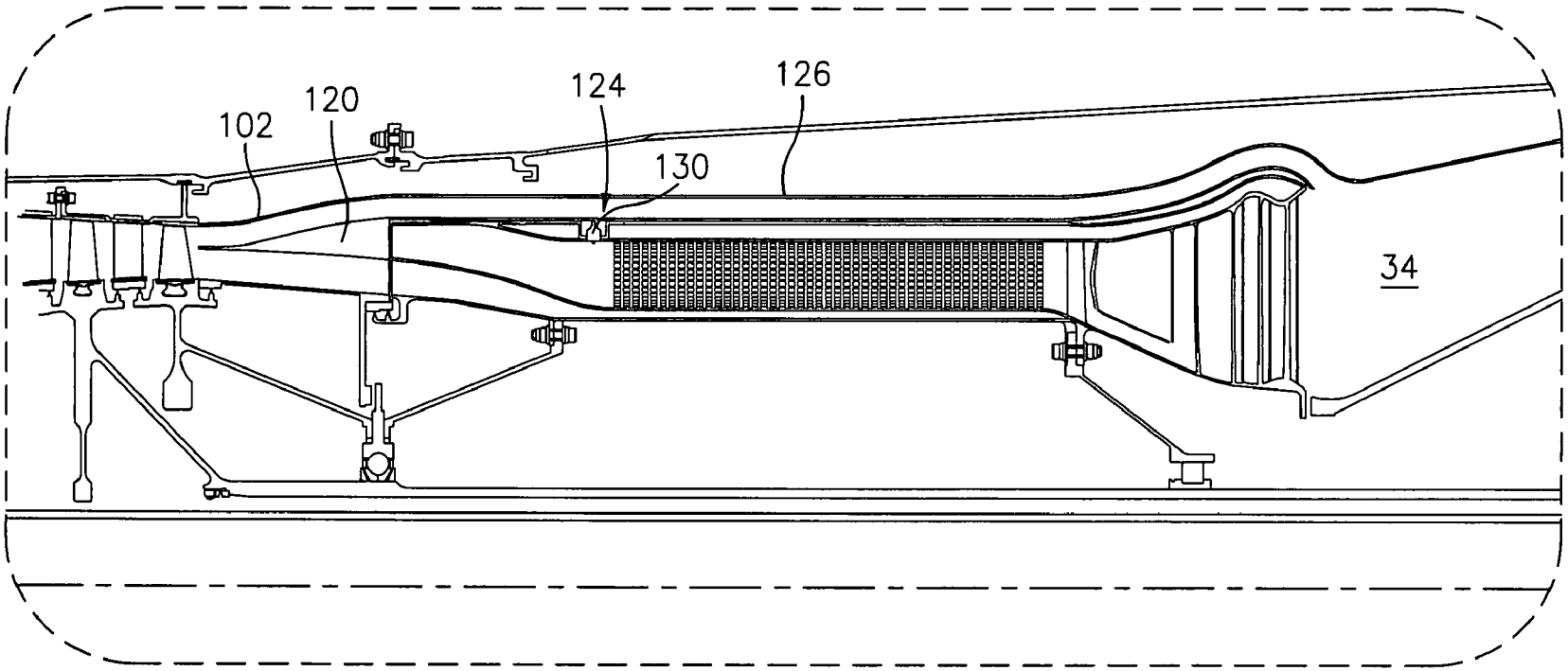
FIG. 5 is a longitudinal sectional view of the combustor of the engine of FIG. 1 along a discharging sector.

Ignition and discharge may occur when each first volume 44 is so sealed. The engine includes means for initiating the combustion of the fuel/air charges in the combustion chambers. Exemplary means initiate this as soon as the first volume 44 is closed off at the beginning of the ignition/discharging sector. FIG. 5 shows means in the form of a single low profile spark plug 130 for each conduit 40. When a single such plug is used, it is advantageously located proximate the upstream end of the first volume 44. In the exemplary embodiment, the plug is mounted in the outboard wall 60 just downstream of its forward rim 92. This exemplary spark plug rotates with the carousel and is powered/controlled by an appropriate distributor mechanism or the like providing electrical communication between rotating and non-rotating portions of the engine. An alternative embodiment would mount the plug 130 in the blocking member 120. Such a mounting may reduce complexity of electrical communication between rotating and non-rotating parts of the engine. Yet alternate initiation systems include multi-point, continuous (e.g., laser or other energy beam), or multi-continuous systems. Examples of such systems are found in U.S. Patent Publication No. 20040123583A1. The first volume 44 has an overall length and a characteristic transverse dimension identified as a diameter. When triggered, the igniter produces a detonation pulse which propagates a flame front radially outward from an associated ignition point at the plug at a supersonic speed (e.g., over about 3,000 feet per second (fps) and typically in the range of 4,000-6,000 fps). Near total combustion will be achieved in the time required for the flame front to travel from the plug to the tube outlet ends 54 or the second volume outlet 48. With the plug proximate the upstream end of the first volume 44 and the diameter substantially smaller than the length, this travel distance is essentially equal to the length. An exemplary operating pressure ratio (OPR) for such detonation combustion is between 2:1 and 6:1.

Combustion gases discharged from the tube outlet ends 54 encounter turning vanes 140 which may be unitarily formed with the carousel disk. In the exemplary embodiment, an equal number of turning vanes 140 are alternatingly interspersed with the tubes 52 and may comprise extensions of the walls of the tubes interspersed with the walls 64 diverting flow through the second passageways. Adjacent vanes divert the discharge flows by an angle relative to the tube axis 506 and local longitudinal centerplane of the engine. In the exemplary embodiment, this diversion applies sufficient torque to the carousel to rotate the carousel at a desired rotational speed. In an exemplary engine, an exemplary steady state rotational speed of the carousel is 2,000-18,000 RPM. The specific operating range will be influenced by engine dimensional considerations in view of carousel structural integrity and the number of charge/discharge cycles per rotation. A narrower range of 6,000-12,000 target RPM is likely with the lower third of this range more likely for a two cycle/rotation engine and the upper third for a one cycle/rotation engine. In operation, these speeds will likely be substantially lower than the high spool speed and approximately the same or moderately lower than the low spool speed. An initial rotation may be provided by the engine starter motor or by a dedicated starter motor for the combustor.

Figure 7:
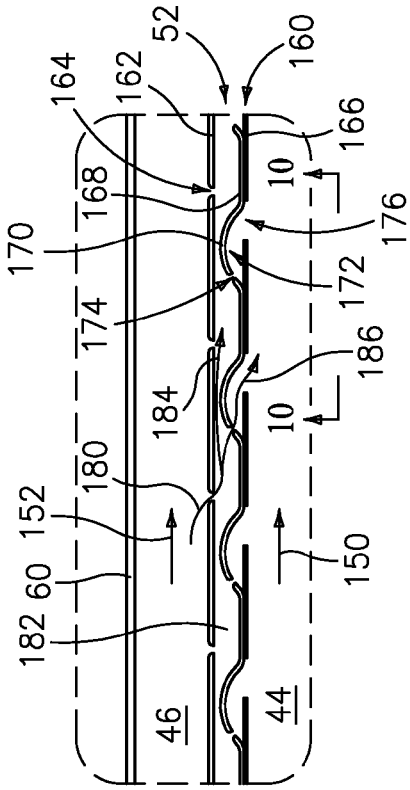
FIG. 7 is an enlarged sectional view of the conduit of FIG. 6.
Figure 6:
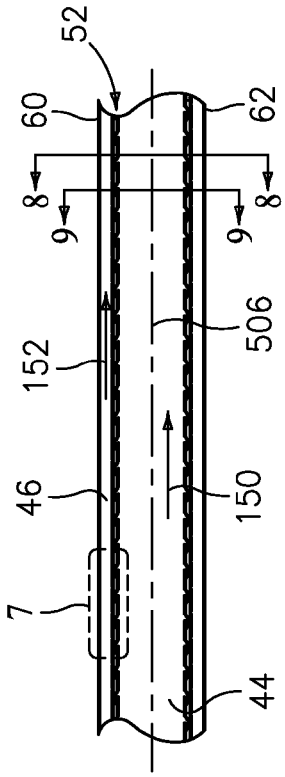
FIG. 6 is a partial longitudinal sectional view of a combustion conduit of the engine of FIG. 1.

Various inventive aspects relate to cooling of the combustion conduits. FIG. 6 shows respective downstream flows 150 and 152 in the volumes 44 and 46. The nature of the respective flows may depend upon the specific cycle stage and the location along the length of the volumes. For example, the flow 150 may be a charging flow, a discharging flow, or a purging flow. As is discussed in further detail below, the flow 152 may principally be a cooling flow which may be influenced by the flow 150. The exemplary tube 52 is foraminate, permitting fluid communication between the flows as well as a conductive thermal communication. FIG. 7 shows details of the exemplary wall of the tube 52. This wall includes an inner first wall structure 160 and an outer second wall structure 162 (intermediate when viewed relative to the wall structure 160 on the one hand and the adjacent outer conduit wall portion 60, 62, or 64 on the other hand). The exemplary second wall structure 162 is a single tubular layer having a circumferential and longitudinal array of metering apertures 164. The exemplary first wall structure 160 is double layered, having a generally tubular inner layer 166 with a blistered outer layer 168 secured thereto. For example, the inner surface of unblistered portions of the outer layer 168 may contact and be secured (e.g., via bonding, welding, or the like) to adjacent portions of the outer surface of the inner layer 166. The blisters 170 on the outer layer 168 cooperate with adjacent portions of the inner layer 166 to define blister internal volumes 172. Each blister has associated therewith one or more apertures 174 in the outer layer 168 and 176 in the inner layer 166.

Figure 9:
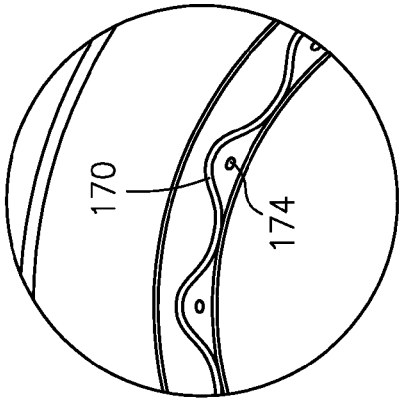
FIG. 9 is a partial transverse sectional view of the core conduit of FIG. 6 taken along line 9-9.
Figure 8:
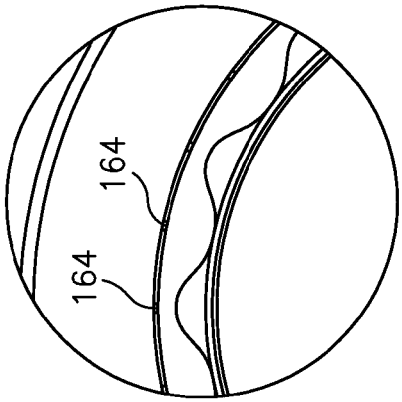
FIG. 8 is a partial transverse sectional view of the conduit of FIG. 6 taken along line 8-8.
Figure 10:
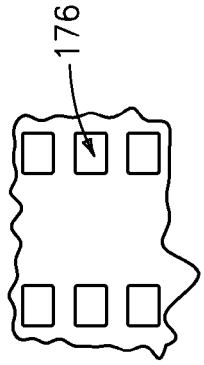
FIG. 10 is a partial interior view of an inner wall of the conduit of FIG. 6.

In an exemplary embodiment, in at least a portion of the charging and purge portions of the cycle, a flow 180 (represented in FIG. 7 by a single streamline although overall potentially representing a much more complex net flow) diverts from the flow 152 in the outer volume/passageway 46 to the inner volume/passageway 44. This flow 180 passes through a volume 182 between the wall structures 160 and 162. In the exemplary embodiment, the apertures 164 are positioned near downstream extremities of adjacent blisters. FIG. 8 shows apertures 164 at an exemplary circumferential pitch of half that of the blisters, with one group of the apertures aligned with the blisters and one group aligned out of phase with the blisters. Some portion of the flow 180 (e.g., schematically represented as 184) will flow around/over the blisters. Another portion (e.g., shown schematically as 186) will flow into the blisters through the apertures 174. FIG. 9 shows the apertures 174 as small circular apertures along leading sides of the blisters. The flow 186 may then pass out of the blister to merge with the flow 150 in the volume/passageway 44 through the apertures 176. Exemplary apertures 176 are relatively large and located relatively downstream along the associated blister. At the downstream end 54 of the tube the flow 184 may be blocked or may be diverted to join one or both of the flows 150 or 152. For example, it may rejoin the flow 152, with the flows 150 and 152 later rejoining at the outlet ends 50 and 48 before encountering the turbine.

The enhanced surface area provided by the wall structure 160 draws substantial cooling from the flows 184 and 186. These cooling flows may be driven by a pressure differential between the volumes 46 and 44. Such a pressure differential may be achieved via appropriate positioning of the duct rim 90 to provide an appropriate initial balance of flows into the volumes. Additionally, the compressor blade immediately ahead of the forward/upstream inlet end 49 may be warped such that a higher pressure flow is directed into the inboard annulus that feeds volume 46 surrounding the combustor tube volume 44. Thus a positive pressure differential across the wall of combustor tube 52 assures cooling airflow into the volume 44 during the refresh cycle. The tube wall geometry promotes cooling in two ways: air entering the blisters 170 through the apertures 174 impinges on the outer surface (backside) of the inner layer 166 and then exits through the apertures 176 to form an unfueled laminar film on the combustion side of inner layer 166.

Especially during ignition and discharge, the pressure increase within the first volume/passageway 44 may cause a reverse flow outward through the wall structure 160. The flow reversal may be minimized by bell-mouthing the edges of apertures 174 and 176 to create a preferential inflow coefficient of discharge (CD). The bell-mouthed apertures would restrict reverse flow when the combustion event causes a pressure rise in volume 44. Additionally, the refresh cycle is substantially longer than the period of time associated with the combustion and blow-down (discharge) event. Thus, the flow time history of the air adjacent to the combustion tube wall 52 will be inboard from volume 46 to volume 44 for the majority of the time and the reverse flow during the brief elevated pressure period of the combustion event will be severely restricted by the bell mouth shaping of apertures 174 and 176. The net effect is a strong cooling action on the inner layer 166 of the combustion tube 52.

In exemplary embodiments, there may be between four and sixty combustion conduits, more narrowly, twenty and forty. Exemplary conduit lengths are between six inches (15 cm) and forty inches (102 cm), more narrowly, twelve inches (30 cm) and thirty inches (76 cm). The exemplary first passageway 44 cross-sectional areas are between 1.0 $inch^2$ (6.5 $cm^2$) and twenty $inch^2$ (129 $cm^2$), more narrowly, 2.0 $inch^2$ (12.9 $cm^2$) and eight $inch^2$ (51.6 $cm^2$). An exemplary discharging sector is between 5° and 120°, more narrowly, 10° and 100°. However, the key limitation regarding the charging sector is the time required to charge the combustion conduits at a given radius from the engine centerline and rotational speed. This gives rise to the possibility of multiple charge/discharge cycles during one 360° rotation of the carousel. In such a situation there could be multiple charging and discharging sectors.

One or more embodiments of the present invention have been described. Nevertheless, it will be understood that various modifications may be made without departing from the spirit and scope of the invention. For example, the details of any particular application will influence the configuration of the combustor. Various features of the combustor may be fully or partially integrated with features of the turbine or the compressor. If applied in a redesign of an existing combustor or turbine engine, details of the existing combustor or engine may implement details of the implementation. The principles may be applied to a variety of existing or yet-developed pulsed combustion devices. The principles may be applied in applications beyond turbine engines. Accordingly, other embodiments are within the scope of the following claims.

What is claimed is:

1. A pulsed combustion apparatus comprising:

a conduit having:

an outer wall;

an inner wall having a plurality of apertures;

an intermediate wall located between the outer wall and the inner wall and having a plurality of apertures; and an interior space separated from the outer wall by the inner wall;

an induction system positioned to cyclicly admit charges to the interior space;

an ignition system positioned to ignite the charges; and flow-directing surfaces positioned to at least cyclicly direct cooling air through the plurality of apertures, the intermediate wall positioned so that the cooling air is directed through the intermediate wall before reaching the inner wall.

2. The apparatus of claim 1 wherein:

the inner wall has an array of pockets; and the plurality of apertures includes, for each of the pockets, a first aperture between an interior of such pocket and a space between the inner and outer walls and a second aperture between the interior of the pocket and the interior space.

3. The apparatus of claim 1 wherein:

the inner wall has an array of pockets; and the plurality of apertures of the inner wall includes, for each of the pockets, a first aperture between an interior of such pocket and a space between the inner and intermediate walls and a second aperture between the interior of the pocket and the interior space.

4. The apparatus of claim 3 wherein the inner wall comprises:

an inner layer; and a outer layer secured to the inner layer and having an array of blisters, cooperating with the inner layer to form the pockets.

5. The apparatus of claim 1 wherein the ignition system is effective to induce detonation of the charges.

6. A turbine engine comprising:

a case having an axis;

a compressor;

a turbine; and a circumferential array of combustion chamber conduits, the conduits being downstream of the compressor and upstream of the turbine, the array being supported for continuous rotation relative to the case in a first direction about the axis to cyclicly bring each conduit from a charging zone for receiving a charge from upstream to a discharging zone for downstream discharging of products of combustion of said charge, wherein each of the conduits comprises an outer wall;

an inner wall; and an interior space separated from the outer wall by the inner wall and having an array of pockets, each pocket having at least one exterior port and at least one interior port.

7. The engine of claim 6 wherein the inner wall comprises:

a first layer;

a second layer secured to an outer surface of the first layer and having an array of outward blisters cooperating with the first layer to form the pockets; and a third layer outboard of the second layer and having an array of orifices.

8. The engine of claim 6 wherein there is a first airflow substantially through said compressor and turbine and wherein a first portion of the first airflow passes the combustion chamber conduits in the charges and a second portion of the first airflow bypasses combustion and a mass flow ratio of the first portion to the second portion is between 1:1 and 1:3.

9. The engine of claim 8 wherein the engine is a turbofan and the first airflow is a core airflow and a bypass airflow bypasses the compressor and turbine and a mass flow ratio of the bypass airflow to the core airflow is between 3:1 and 9:1.

10. The engine of claim 6 wherein said combustion comprises detonation.

11. The engine of claim 6 wherein the array is on a free spool and said rotation is driven by partially tangential direction of the products of combustion.

12. The engine of claim 6 wherein said turbine and compressor each comprise high and low stages on respective high and low spools and the array is on a free spool.

13. The engine of claim 6 further comprising a plurality of igniters, each of which is positioned relative to an associated one of the conduits to ignite the combustion of the charge in said associated conduit.

14. A turbine engine comprising:

a compressor;

a turbine coaxial with the compressor along an axis; and a pulsed combustion combustor receiving air from the compressor and outputting combustion gasses to the turbine and having:

a plurality of combustion chamber conduits having first and second chambers and held for rotation about the axis through a plurality of positions, including:

at least one charge receiving position for receiving a charge from upstream;

at least one initiation position for initiating combustion of the charge;

at least one discharge position for downstream discharging of products of combustion of said charge; and, at least one cooling position cooling a wall separating the first and second chambers by directing cooling air from the second chamber to the first chamber through a plurality of apertures in the wall.

15. The engine of claim 14 further comprising at least one fuel injector for injecting fuel into air from the compressor to form the charges.

16. The engine of claim 14 wherein the at least one cooling position overlaps a majority of the at least one charge receiving position.

17. The engine of claim 16 wherein:

each of the conduits has an inlet and an outlet; and the at least one discharge position includes first discharge position where the inlet is blocked and a purge position where the inlet is unblocked; and the at least one cooling position overlaps a majority the at least one purge position.

18. The engine of claim 16 further comprising a nonrotating manifold portion having:

at least a first sector conveying air to an aligned transient first group of the combustion conduits; and at least a second sector blocking upstream ends of an aligned transient second group of the combustion conduits from upstream communication.

19. The engine of claim 16 wherein there are at least ten such combustion conduits.

20. A method for operating a turbine engine having a plurality of combustion chamber conduits, each conduit having a wall and a plurality of apertures in the wall and held for infinite rotation about an axis, the method comprising:

compressing inlet air;

with each of the conduits, cyclicly:

admitting a charge of said compressed inlet air and a fuel to such conduit as such conduit passes along a charging portion of the rotation;

initiating combustion of the charge;

discharging products of the combustion from such conduit; and admitting a cooling portion of the compressed air through said plurality of apertures in said wall of the conduit; and extracting work from the discharged products.

21. The method of claim 20 wherein:

the wall of each conduit is an inner wall;

the admitting the charge is at least partially concurrent with the admitting the cooling portion;

the admitting the cooling portion comprises:

passing the cooling portion between an outer wall and the inner wall;

passing the cooling portion through a first group of the plurality of apertures in an outer layer of the inner wall;

passing the cooling portion through a second group of the plurality of apertures in an inner layer of the inner wall, the inner layer having a plurality of blisters and each of the apertures of the second group being in an exterior portion of an associated one of the blisters; and passing the cooling portion through a third group of the plurality of apertures in the inner layer of the inner wall, each of the apertures of the third group being in an interior portion of an associated one of the blisters.

22. A pulsed combustion apparatus comprising:

a conduit having:

an outer wall;

an inner wall;

an interior space separated from the outer wall by the inner wall, the inner wall having an array of pockets and a plurality of apertures, the plurality of apertures including, for each of the pockets, a first aperture between an interior of such pocket and a space between the inner and outer walls and a second aperture between the interior of the pocket and the interior space; and an induction system positioned to cyclicly admit charges to the interior space;

an ignition system positioned to ignite the charges; and flow-directing surfaces positioned to at least cyclicly direct cooling air through the plurality of apertures.

* * * * *